United States Patent [19]

Aoki et al.

[11] Patent Number: 4,764,960

[45] Date of Patent: Aug. 16, 1988

[54] STEREO REPRODUCTION SYSTEM

[75] Inventors: Shigeaki Aoki, Yokohama; Nobuo Koizumi, Yokosuka, both of Japan

[73] Assignee: Nippon Telegraph and Telephone Corporation, Tokyo, Japan

[21] Appl. No.: 70,994

[22] Filed: Jul. 8, 1987

[30] Foreign Application Priority Data

Jul. 18, 1986 [JP] Japan ..... 61-169613
Jul. 18, 1986 [JP] Japan ..... 61-169614

[51] Int. Cl.[4] ..... H04R 5/02

[52] U.S. Cl. ..... 381/24; 381/90; 381/188; 381/205

[58] Field of Search ..... 381/88, 89, 90, 24, 381/188, 205, 86, 18

[56] References Cited

U.S. PATENT DOCUMENTS 4,703,502 10/1987 Kasai et al. ..... 381/86

*Primary Examiner*—Forester W. Isen

*Attorney, Agent, or Firm*—Pollock, Vande Sande and Priddy

[57] ABSTRACT

First left and right channel loudspeakers having respective main axes of directivities directed toward left and right listening areas defined in front thereof are provided. In addition, there are provided a second right channel loudspeaker near the first right channel loudspeaker with a main axis of directivity directed toward the left listening area, a second left channel loudspeaker near the first left channel loudspeaker with a main axis of directivity directed toward the right listening area, and signal adjusting means for controlling the relative amplitude and time difference among the signals to be supplied to these loudspeakers.

13 Claims, 5 Drawing Sheets

STEREO REPRODUCTION SYSTEM

BACKGROUND OF THE INVENTION

This invention relates to a stereo reproduction system which can provide satisfactory localization effect in a broad listening area in a loudspeaker's small distance field.

Generally, in a two-channel stereo reproduction system most satisfactory localization effect (positional recognition of sound images produced by stereo reproduction) is obtainable at a listening position a certain distance forward from the position midway between two loudspeakers such as in a relation where two loudspeakers and listening position constitute apices of a regular triangle.

This is so because the localization effect of the sound image can be obtained from the sound pressure difference and sound arrival time difference between the two ears. If the distance of the listening position from the loudspeakers is large, the difference between the distances from the listener to the two loudspeakers itself does not greatly affect the sound pressure difference and time difference between the two ears. Therefore, satisfactory localization effect can be obtained in comparatively wide areas on both sides of a line vertically bisecting the line connecting the two loudspeakers (hereinafter referred to as center line). However, in a listening area where the distance of the listening position from the loudspeakers is small, the sound pressure difference and time difference between the two ears due to the difference between the distances, through which sounds from the two loudspeakers reach the listener, vary greatly depending on the listening position. Therefore, the listening area where satisfactory localization effect can be obtained is limited to a small area intersecting the center line between the two loudspeakers. Therefore, the smaller is the distance from the loudspeaker the narrower is the satisfactory listening area. The listening area where the satisfactory localization effect is obtainable can be shifted from the aforementioned small area intersecting the center line through electrical control of the sound pressure difference and time pressure difference of either one of the left and right channel signals with respect to the other. However, even if it can be shifted, it is impossible to expand the satisfactory listening area.

SUMMARY OF THE INVENTION

A first object of the invention is to provide a stereo reproduction system, which can provide satisfactory localization effect for not only the center listening area ahead of the center of the two loudspeakers but also listening areas on both sides of the center listening area even in the loudspeaker's small distance sound field.

A second object of the invention is to provide a stereo reproduction system, which can provide satisfactory localization effect even in a low frequency region as well as attaining the first object.

A third object of the invention is to provide a stereo reproduction system, which can control the sound pressure difference and arrival time difference between the two ears under remote control in order to attain the first object.

According to the invention, there are provided a first right channel loudspeaker, to which a right channel signal is supplied, and which has a main axis of directivity directed toward a right listening area defined in front thereof, and a first left channel loudspeaker, to which a left channel signal is supplied, and which has a main axis of directivity directed toward a left listening area defined in front thereof. Also, there are provided second right and left channel loudspeakers provided near the respective first right and left channel loudspeakers. The second right channel loudspeaker is supplied with the right channel signal, and its main axis of directivity is toward the left listening area. The second left channel loudspeaker is supplied with the left channel signal, and its main axis of directivity is toward the right listening area. Between the right and left listening areas is defined a central listening area. Means are provided for controlling the relative amplitude and time difference between the signals to be supplied to the first and second right and left channel loudspeakers such that sound heard in the right listening area can be suitably localized. Signal control means are also provided for controlling the relative amplitude and time difference of the signals to be supplied to the first left channel loudspeaker and second right channel loudspeaker such that sound heard in the left listening area can be suitably localized.

Further, if desired, a third right channel loudspeaker is provided near the first right channel loudspeaker. The third right channel loudspeaker is supplied with the polarity-inverted right channel signal, and its main axis of directivity is directed toward the outside of the right listening area opposite from the central listening area. Further, a third left channel loudspeaker is provided near the first left channel loudspeaker. The third left channel loudspeaker is supplied with the polarity-inverted left channel signal, and its main axis of directivity is directed toward the outside of the left listening area opposite from the central listening area.

If necessary, the adjusting mechanism for controlling the direction of the second right channel loudspeaker and adjusting mechanism for controlling the direction of the second left channel loudspeaker are provided. These signal control means and adjusting mechanisms are remote-controlled through remote control means.

DETAILED DESCRIPTION OF THE PREFERRED EMBODIMENT

Figure 1:
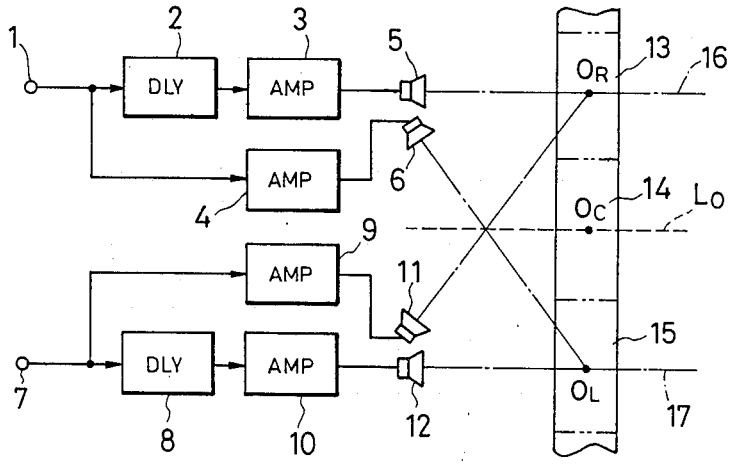
FIG. 1 is a block diagram showing an embodiment of the invention.

Referring now to FIG. 1, a right channel signal input terminal 1 is connected through a variable delay circuit 2 to the input side of an amplifier 3 and is also connected directly to the input side of an amplifier 4. The output side of the amplifiers 3 and 4 are respectively connected to respective first and second right channel loudspeakers 5 and 6. A left channel signal input terminal 7 is connected to the input side of an amplifier 9 and is also connected through a variable delay circuit B to the input side of an amplifier 10. Amplifiers 10 and 9 are connected to respective first and second left channel loudspeakers 12 and 11. At least one of the amplifiers 3 and 4 and at least one of the amplifiers 9 and 10 are variable gain amplifiers. In the actual system, however, all the amplifiers are preferably variable gain amplifiers.

First right and left channel loudspeakers 5 and 12 have main axes 16 and 17 of acoustic emission substantially in parallel and directed frontwards. In some cases, the main axes may be directed slightly outwardly or inwardly with respect to each other.

There is a central listening area 14 ahead on the center line $L_O$ vertically bisecting the line connecting the first right and left channel loudspeakers 5 and 12. The right and left listening areas 13 and 15 are located in front of the first right and left channel loudspeakers 5 and 12 such that the areas 13, 14 and 15 are laterally aligned in parallel relation to the arrangement of the loudspeakers 5 and 12. It should be understood that there are no definite borderlines defining these three listening areas 13 to 15. The arrangement of these three listening areas 13 to 15 is comparatively close to loudspeakers 5, 6, 11 and 12 such that the center $O_C$ of the listening area 14 locates inside a regular triangle regarding the loudspeakers 5 and 12 as its apexes. The directivity of the second right channel loudspeaker 6 is toward the left listening area 15 in front of the first left channel loudspeaker 12, and the main axis of directivity of the second left channel loudspeaker 11 is toward the right listening area 13 in front of the first right channel loudspeaker 5.

Figure 2:
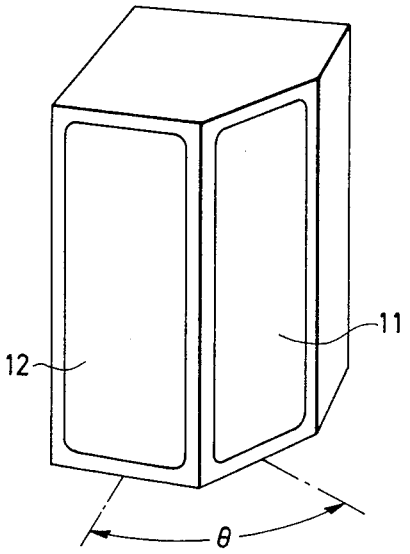
FIG. 2 is a perspective view showing an example of construction of loudspeakers as applied to the left channel loudspeakers in FIG. 1.
Figure 3:
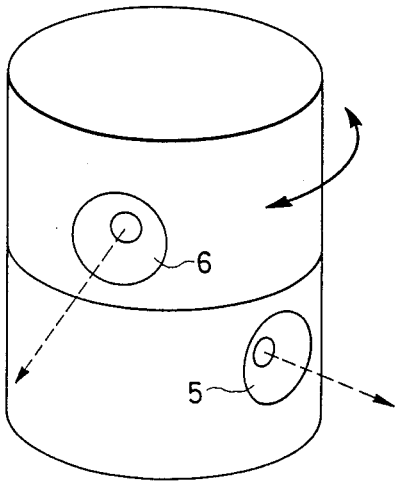
FIG. 3 is a view showing another example of construction of the loudspeakers as applied to the right channel loudspeakers in FIG. 1.

FIG. 2 shows an example of construction of the left channel loudspeakers 11 and 12. The loudspeaker 12 has the main axis of acoustic emission directed toward the left listening area 15, and the loudspeaker 11 has the main axis of acoustic emission directed diagonally toward the right listening area 13. Although not shown, the loudspeaker 11 is freely rotatable about a vertical axis. Therefore, it is possible to freely vary the installation angle, i.e., the angle $\theta$ of the main axis of acoustic emission of the loudspeaker 11 with respect to the main axis of acoustic emission of the loudspeaker 12. The arrangement of the right channel loudspeakers 5, 6 has a construction symmetrical to that shown in FIG. 2. Further, as shown in FIG. 3, it is possible to arrange the loudspeakers 5 and 6 one above another as right channel loudspeakers and permit rotation of the directivity of the loudspeaker 6. At this time, the left channel loudspeakers 11, 12 are of the structure symmetrical to that shown in FIG. 3.

In the system having the above construction, there is an arrival time difference due to the difference between the travel distance from the loudspeaker 6 to a representative listening position, e.g., center $O_L$, in the left listening area 15 and the travel distance from the loudspeaker 12 to the listening position $O_L$. To compensate for this, a time delay is given by a delay circuit 8. There is a propagation attenuation level difference due to the difference between the travel distance from the loudspeaker 6 to the typical listening position $O_L$ and the travel distance from the loudspeaker 12 to the typical listening position $O_L$. To compensate for this, the gain of the amplifier 4 is adjusted so that correct localization can be obtained in the listening area 15. In other words, it is adjusted such that the amplifiers 3 and 9 are made off or their gains are set to zero to provide no emission of sound from the loudspeakers 5 and 11, and when the same signal is supplied to the input terminals 1 and 7, the sound from the loudspeaker 6 and that from the loudspeaker 12 become the same level at the listening position $O_L$. Thus, when the same signal is supplied to the input terminals 1 and 7, the sound from the loudspeaker 6 and sound from the loudspeaker 12 simultaneously reach the listening position $O_L$ with their levels equal to each other. In the same way, the delay time of the delay circuit 2 and the gain of the amplifier 9 are adjusted for a representative listening position, e.g., $O_R$ of the right listening area 13 in the absence of the sound from the loudspeakers 6 and 12. In order to adjust the amplifiers and delay circuits in order that the sound from the two loudspeakers arrive simultaneously at the same level at the listening positions $O_L$ and $O_R$, the sound pressure levels and arrival time differences may be measured by using measuring instruments at these positions $O_L$ and $O_R$. Alternatively, the operator at positions $O_L$ and $O_R$ may listen to actual sound and adjust the delay time of the delay circuits and gain of the amplifiers such that a sound image is localized at a predetermined position, e.g., the sound image is localized midway between the right and left channel loudspeakers when the same signal is applied to the terminals 1 and 7. In this case, the gains of the amplifiers 3 and 10 are also varied, and the foregoing adjustment is repeated for respective gains. In this way, the amplifiers 3 and 10 are set to the gains which seem to provide most accurate localization of the sound image. Through this adjustment, satisfactory localization effect can be obtained over the range of the listening areas 13 to 15. Supposing that the aforementioned distance difference is generally 34 cm or greater, the delays of the delay circuits 2 and 8 should be about 1 msec. or longer. Further, when the delay exceeds about 30 msec., the sound is usually felt like echo, so that the delay should be within 30 msec.

When the above adjustment is ended, sounds from the loudspeakers 5 and 11 are heard in the listening area 13, so that the listener localizes sound image between the loudspeakers 5 and 11. The sound of the loudspeaker 6 is hardly heard in the listening position 13 since the directivity of the loudspeaker 6 is directed toward the listening area 15. The sound from the loudspeaker 12 arrives in the listening area 14 with a delay of about 1 msec. or longer relative to the sound from the loudspeaker 11 due to the delay in the delay circuit 8. Therefore, only the latter sound is sensible to the human ears due to the so-called precedence effect. In general, the arrival time difference between the sounds from the left and right loudspeakers which gives the sense of stereo is about 1 msec. or shorter. While, the arrival time difference which provides the precedence effect is about 1 msec. or longer, but if the delay is set to be about 30 msec. or longer it is felt like an echo as mentioned previously.

In the central listening area 14 the sounds from the loudspeakers 6 and 11 are heard, and the listener localizes a sound image from these sounds. The sounds from the loudspeakers 5 and 12 arrive in the listening area 14 with a delay of about 1 msec. or longer with respect to the sounds from the loudspeakers 6 and 11 and, therefore, are not audible due to the precedence effect. Likewise, a sound image is localized between the loudspeakers 12 and 6 when the listener is in the listening area 15.

Figure 4:
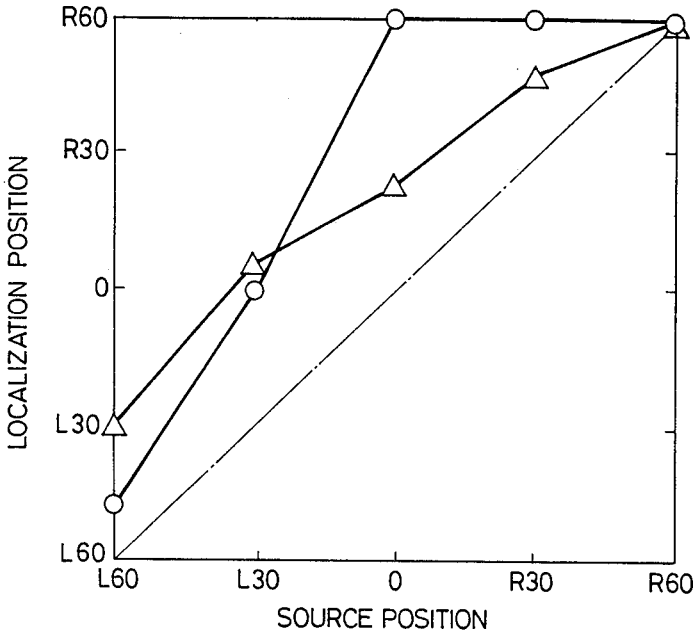
FIG. 4 is a graph showing the results of subjective evaluation at right side listening position in the prior art system and the system of the embodiment shown in FIG. 1.
Figure 5:
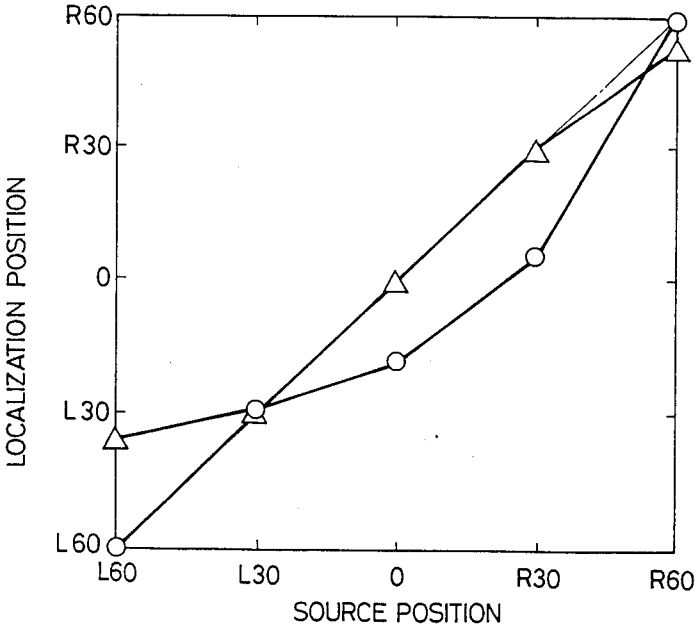
FIG. 5 is a graph showing the results of subjective evaluation at central listening position.

FIGS. 4 and 5 show examples of the results of subjective evaluation test of the sound image localization with the system according to the invention and prior art system. The example of FIG. 4 concerns the right side listening position (center $O_R$ of the listening area 13 in FIG. 1). In the Figure, the abscissa represents the position of the actual sound source when the sound was collected by microphones. $L_{60}$ and $R_{60}$ represent 0.6 m to the left side and 0.6 m to the right side from the center. Circles represent the result of the prior art two-channel stereo reproduction system, and triangles represent the results of the system according to the invention. It is satisfactory if the results of test are on a diagonal broken line at an angle of 45 degrees. Generally, when the angle between the listener's two ears seen from a sound source is large, a clearer localization effect with respect to the sound source can be obtained. More particularly, since the listener is positioned in the right listening position $O_R$, the localization effect obtainable when the actual sound source is at $R_{60}$, $R_{30}$ and O is important. In this case, FIG. 4 shows that the invention has a great effect. If the angle seeing the two ears is small, i.e. when the actual sound sources are at $L_{60}$ and $L_{30}$, there is no substantial difference in the localization effect between the system according to the invention and prior art system. FIG. 5 shows an example of test results obtained when the listener was at the central listening position $O_C$. Various parameters are the same as those in the case of FIG. 4. It is shown that the system according to the invention is superior.

It will be seen that in the listening area 13 the sound image is localized by the sounds from the loudspeakers 5 and 11, in the listening area 14 by the sounds from the loudspeakers 6 and 11 and in the listening area 15 by the sounds from the loudspeakers 6 and 12. In consequence, a sound image can be localized in the listening areas 13 and 15 as well as in the listening area 14. That is, the sound image can be correctly localized even on both sides of the center listening area 14 with the same effectiveness as when listening to the sound on the center line of the two loudspeakers of prior art two-channel stereo system.

As is apparent from the results, according to the invention satisfactory localization effect can be obtained with respect to a broad listening area in the small distance sound field of the reproduction loudspeakers. The broad listening area is shown as if to have three distinct divisions. In reality, however, the boundaries between these divisions vary smoothly, and it would suffice if the listener stays inside the listening areas 13, 14 and 15.

Figure 6:
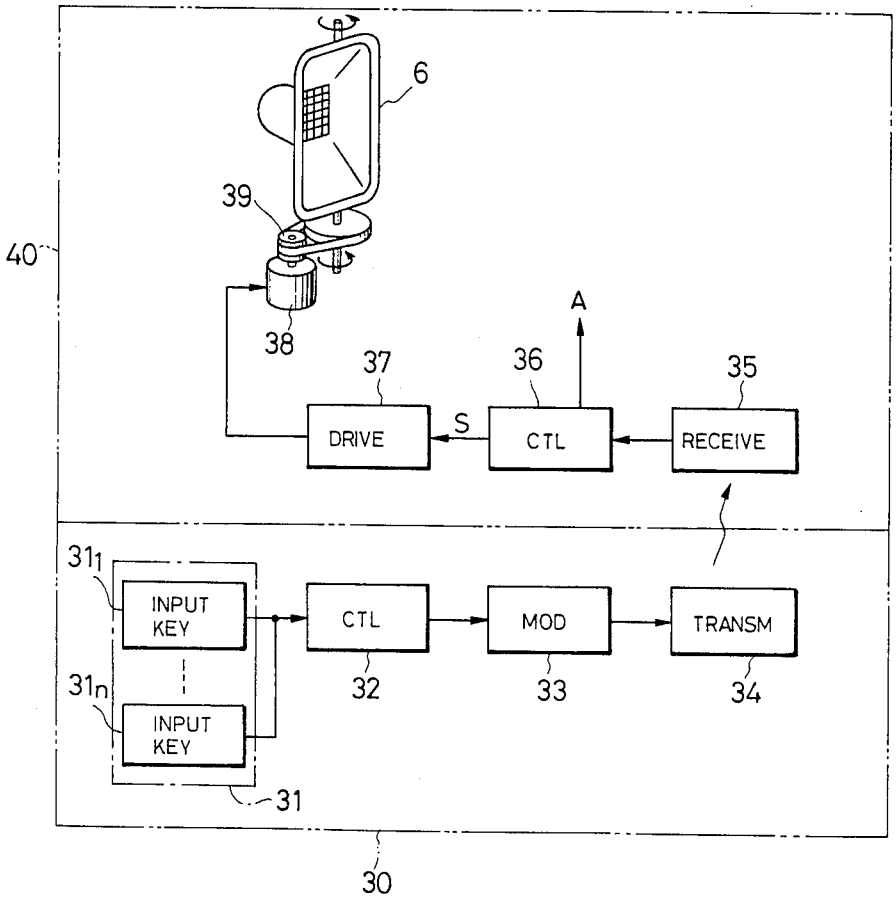
FIG. 6 is a block diagram showing an arrangement for rotating the direction of a loudspeaker through remote control.

FIG. 6 concerns the case when the direction angle $\theta$ of the loudspeakers 5 and 6 or 11 and 12 are arranged controllable under remote control, but shows only the construction for varying the installation angle by rotating the loudspeaker 6. The loudspeaker drive circuit is the same as that in FIG. 1, so that it is not shown. A remote control system 30 controls the installation angle of the loudspeaker 6 from a position spaced apart therefrom. Its operating part 31 is constituted by input keys or like input means $31_1$ to $31_n$. For instance, the number of times of depressing an angle control key $31_1$ corresponds to the angle of rotation of the loudspeaker 6, and the direction of rotation of the loudspeaker 6 is determined by a direction control key $31_2$. These input keys $31_1$ to $31_n$ have various function keys including volume control keys. A control section 32 provides an identification code of each function key to input control signal (control amount code) from the operating part 31. A carrier wave is modulated in a modulating section 33 according to the output from the control section 32 and is sent out from a transmitting section 34. The transmitted signal may be infrared rays, for instance. In this case, the transmitting section 34 constitutes an infrared ray source. A loudspeaker system 40 is assembled in a loudspeaker housing. In a receiving section 35, a signal transmitted from the remote control system 30 is received and demodulated to obtain a signal consisting of an identification code and control amount code. In a control section 36, the identification code is judged to be provided as volume control signal A or drive control signal S. A drive circuit 37 amplifies the drive control signal to drive a motor 38 for rotating the loudspeaker 6 through a rotation transmission system 39. An arrangement for controlling the rotation of the motor 38 according to a pulse number, is shown in, for instance, W. Steinberg et al U.S. Pat. No. 3,560,830 entitled "Positional Control System with Backlash Compensation". For volume control, an up-down counter is caused to execute up- or down-counting in accordance with the direction control by the number of times of key operation in the operating part 31. The count of the up-down counter is converted by a DA converter into an analog signal, and the gain of the amplifier is controlled according to the magnitude of the analog signal. By causing the rotation of the loudspeaker under remote control from the listening position in this way, continuous real-time control can be obtained, and changes before and after the adjustment can be clearly recognized, and smooth control can be obtained.

Figure 7:
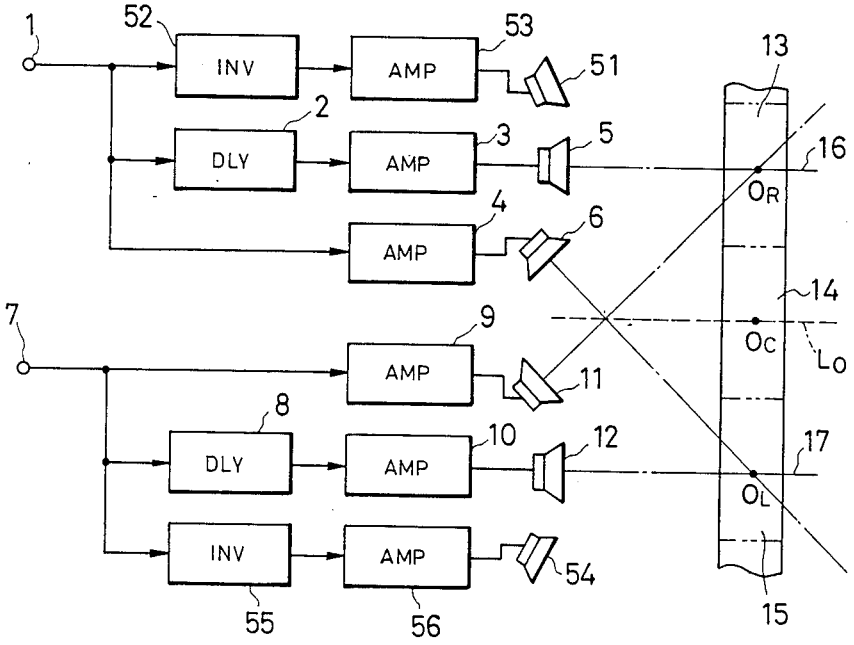
FIG. 7 is a block diagram showing another embodiment of the invention.

If the directivity characteristic of the loudspeaker 6 in the embodiment shown in FIG. 1 is broad, the sound from the loudspeaker 6 also reaches the listening area 13, so that the operation described above can not be done correctly. This is liable to give rise to problems in that the directivity characteristic of the loudspeaker 6 can not be made sufficiently sharp particularly in the low frequency band. To solve this problem, the construction as shown in FIG. 7 may be used. In FIG. 7, parts like those in FIG. 1 are designated by like reference numerals. In the neighborhood of the first right channel loudspeaker 5 a third right channel loudspeaker 51 is provided on the side opposite the second right channel loudspeaker 6. The directivity of the third right channel loudspeaker 51 is toward the outside, and the right channel signal from the input terminal 1 is inverted in polarity by an inverter 52 to be supplied through a variable gain amplifier 53 to the third right channel loudspeaker 51. Likewise, in the neighborhood of the first left channel loudspeaker 12 a third left channel loudspeaker 54 is provided on the side opposite the second left channel loudspeaker 11. The directivity of the third left channel loudspeaker 54 is also directed to the outside. The left channel signal from the input terminal 7 is supplied through an inverter 55 and a variable gain amplifier 56 to the third left channel loudspeaker 54.

Figure 8:
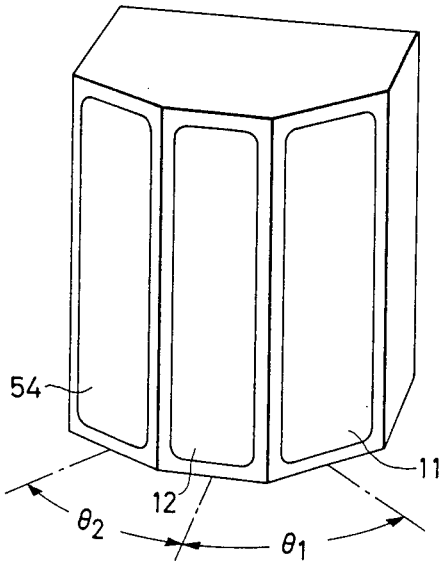
FIG. 8 is a perspective view showing an example of the construction of the loudspeakers as applied to the left channel loudspeakers in FIG. 7.

FIG. 8 shows an example of assembly of the left channel loudspeakers shown in FIG. 7. The second and third left channel loudspeakers 11 and 54 have their main axes of acoustic emission directed inwardly toward the front to form an angle $\theta_1$ and outwardly toward the front to form an angle $\theta_2$, respectively, with respect to the main axis of acoustic emission of the first left channel loudspeaker 12. These loudspeakers are rotatable about their vertical axes. An assembly of the right channel loudspeakers has a construction similar to what is shown in FIG. 8.

In this arrangement, the gain of the amplifiers 3, 4, 9 and 10 and delay time of the delay circuits 2 and 8 are adjusted in the same manner as described before in connection with the embodiment of FIG. 1. The directivity of the loudspeaker 51 is directed slightly outwardly of the listening area 13, and the gain of the amplifier 51 is adjusted so that localization-in-head is produced at the center $O_R$ of the listening area 13. In other words, the levels of the sounds from the loudspeakers 6 and 51 are made equal at the center $O_R$ of the listening area 13. For the loudspeaker 54 the gain of the amplifier 56 is adjusted such that localization-in-head of the sounds from the loudspeakers 54 and 11 is produced at the center $O_L$ of the listening area 15.

In the listening area 13, the sounds from the loudspeakers 6 and 51 reach at the same time and interfere with each other to form a directivity valley, thereby reducing the level of the unnecessary sound from the loudspeaker 6. Moreover, since opposite-phase sounds enter the two ears of the listener, the listener localizes the sound image of small volume in the head, and the direction of its arrival is not known. However, immediately afterwards, sounds of greater volumes than this reduced sound is heard from the loudspeakers 5 and 11, and the listener is forced to localize the sound image between the loudspeakers 5 and 11. Meanwhile, the sound from the loudspeaker 12 arrives the listening area 13 with its level smaller than the sound from the loudspeaker 11 and with a delay time of about 1 msec. or longer, so that the sound from the loudspeaker 12 is not sensed due to the precedence effect. The directivity of the loudspeaker 54 is directed toward outside of the listening area 15, so that in the listening area 13 the level of sound from the loudspeaker 51 can be ignored.

In the listening area 14 the sounds from the loudspeakers 6 and 11 are heard, so that the listener localizes the sound image from these sounds. However, the sounds from the loudspeakers 51 and 54 are emitted to the outside of all the listening areas 13, 14 and 15 due to the loudspeaker's directivity characteristics, so that they can not be heard as direct sound. The sounds from the loudspeakers 5 and 12 which arrive next will arrive with a delay time of about 1 msec. or longer, so that it can not be sensed due to the precedence effect of the preceding sound localization.

In the listening area 15 the sounds from the loudspeakers 11 and 54 will arrive at the same time and interfere with each other to form a directivity pattern valley, so that the level of the unnecessary sound from the loudspeaker 11 is reduced. At the same time, opposite phase sounds from the loudspeakers 11 and 54 enter the two ears of the listener, so that the sound image of small volume is localized in the head. Immediately afterwards, sounds from the loudspeakers 6 and 12 of greater volumes than these mutually interfering sounds are heard, and the listener localizes sound image between the loudspeakers 6 and 12. Meanwhile, the sound from the loudspeaker 5 arrives with a delay time of about 1 msec. or longer and, moreover, its volume is smaller than the sound from the loudspeaker 6, so that the sound from the loudspeaker 6 can not be sensed due to the precedence effect of the preceding sound localization. Since the sound from the loudspeaker 51 is directed toward the outside of the listening area 13, the sound is of an ignorable level as direct sound in the listening area 15.

As a result, in the listening area 13 the sound image is localized by the sounds from the loudspeakers 5 and 11, in the listening area 14 by the sounds from the loudspeakers 6 and 11, and in the listening area 15 by the sounds from the loudspeakers 6 and 12. In consequence, the sound image can be correctly localized outside the center listening area 14 in the same state as when the sound is listened to in the center listening area in the prior art two-channel stereo system.

Figure 9:
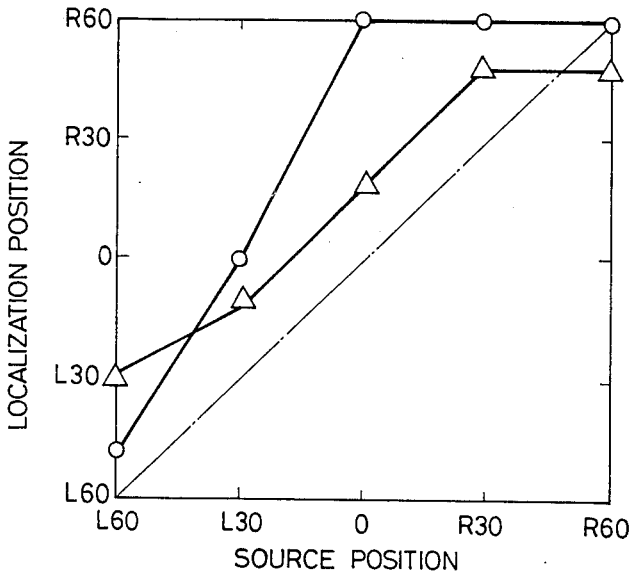
FIG. 9 is a graph showing the results of subjective evaluation at right side listening position when the prior art system and the system of the embodiment of FIG. 7 are used.
Figure 10:
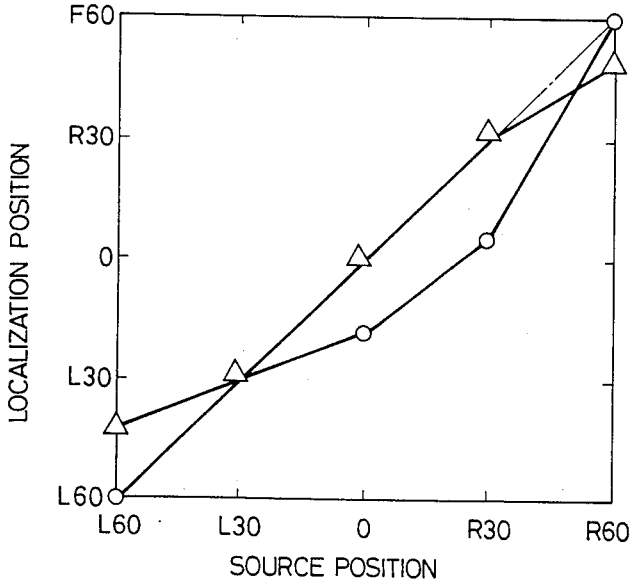
FIG. 10 is a graph showing the results of subjective evaluation at central listening position.

FIGS. 9 and 10 show examples of the results of subjective evaluation test of the system according to the invention and prior art system. The parameters are the same as in the case of FIG. 4. FIG. 9 shows the case of the right side listening position (listening position $O_R$ in FIG. 7), and FIG. 10 shows the case of the central listening position (listening position $O_C$ in FIG. 7). The results according to the prior art system are labeled by circles, and the results according to the invention are labeled by triangles. These results according to the invention, compared to the results obtained with the prior art two-channel stereo reproduction system, are closer to the diagonal broken line at the angle of 45 degrees, thus indicating the effectiveness of the invention.

As is apparent from the results according to the invention, satisfactory localization effect can be provided for a broad listening area in the small distance sound field from the reproduction loudspeakers.

With the construction as in FIG. 6, the installation angles of the loudspeakers 5, 6 and 51 and loudspeakers 11, 12 and 54 (i.e., angles indicated by $\theta_1$ and $\theta_2$ in FIG. 8) can each be controlled individually through remote control, and also the gains of the amplifiers may be controlled through remote control.

Figure 11:
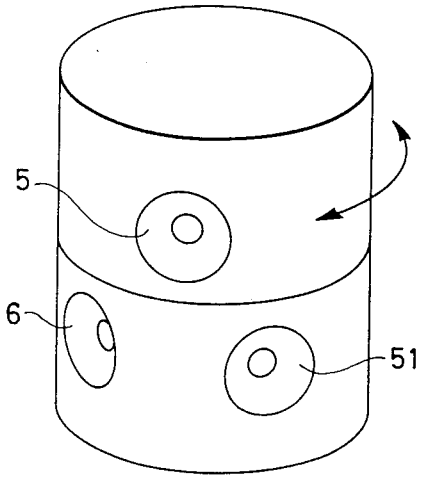
FIG. 11 is a perspective view showing another example of the construction of the loudspeakers as applied to the right channel loudspeakers in FIG. 7.

Each assembly of the loudspeakers 5, 6 and 51 and assembly of the loudspeakers 11, 12 and 54 may be disposed in two parts disposed one above another, one being constituted, for example, by the loudspeaker 5 and the other being constituted by the loudspeakers 6 and 51, as shown in FIG. 11, and one of these two loudspeaker parts, e.g., the loudspeaker 5, may be rotatable to vary the installation angles $\theta_1$ and $\theta_2$.

As each of the loudspeakers 5, 6, 11 and 12, use can be made of two or three loudspeakers for respective high and low frequencies. In this case, the loudspeakers 51 and 54 in the embodiment shown in FIG. 7 may be of the low frequency band, only. The invention is applicable not only to the two-channel stereo system but also to the 4-channel stereo system.

We claim:

1. A stereo reproduction system comprising:

a first right channel loudspeaker supplied with a right channel signal and having a main axis of directivity toward a right listening area defined in front thereof;

a first left channel loudspeaker supplied with a left channel signal and having a main axis of directivity toward a left listening area defined in front thereof;

a second right channel loudspeaker supplied with a right channel signal and having a main axis of directivity toward said left listening area;

a second left channel loudspeaker supplied with said left channel signal and having a main axis of directivity toward said right listening area;

first signal adjusting means for adjusting the relative amplitude and time difference of signals to be supplied to said first right channel loudspeaker and said second left channel loudspeaker such that the sound heard in said right listening area is stably localized; and second signal adjusting means for adjusting the relative amplitude and time difference of signals supplied to said first left channel loudspeaker and second right channel loudspeaker such that the sound heard in said left listening area is stably localized.

2. The stereo reproduction system according to claim 1, comprising a first adjusting mechanism for controlling the direction of said second right channel loudspeaker, a second adjusting mechanism for controlling the direction of said second left channel loudspeaker, and remote control means for controlling said first and second adjusting mechanisms through remote control.

3. The stereo reproduction system according to claim 1, further comprising a third right channel loudspeaker provided in the neighborhood of said first right channel loudspeaker, having a main axis of directivity directed to the outside of said right listening area oppposite from said left listening area, and supplied with a signal obtained as a result of polarity inversion of said right channel signal, a third left channel loudspeaker provided in the neighborhood of said first left channel loudspeaker, having a main axis of directivity directed toward the outside of said left listening area opposite from said right listening area, and supplied with a signal obtained as a result of polarity inversion of said left channel signal, third signal adjusting means for adjusting the relative levels of the sounds from said second and third right channel loudspeakers so that they are equal in said right listening area, and fourth signal adjusting means for adjusting the relative levels of the sounds from said second and third left channel loudspeakers such that they are equal in said left listening area.

4. The stereo reproduction system according to claim 3, further comprising a first adjusting mechanism for controlling the direction of said first right channel loudspeaker, a second adjusting mechanism for controlling the direction of said first left channel loudspeaker, and remote control means for independently controlling said first and second adjusting mechanisms through remote control.

5. The stereo reproduction system according to claim 4, further comprising a third adjusting mechanism for controlling the direction of said second right channel loudspeaker, a fourth adjusting mechanism for controlling the direction of said third right channel loudspeaker, a fifth adjusting mechanism for controlling the direction of said second left channel loudspeaker, and a sixth adjusting mechanism for controlling the direction of said third left channel loudspeaker, said remote control means being capable of controlling said third to sixth adjusting mechanisms independently through remote control.

6. The stereo reproduction system according to claim 3, further comprising a first adjusting mechanism for controlling the direction of said second right channel loudspeaker, a second adjusting mechanism for controlling the direction of said third right channel loudspeaker, a third adjusting mechanism for controlling the direction of said second left channel loudspeaker, a fourth adjusting mechanism for controlling the direction of said third left channel loudspeaker, and remote control means for controlling said first to fourth adjusting mechanisms independently through remote control.

7. The stereo reproduction system according to claim 1 or 2, wherein said first signal adjusting means includes a first variable delay circuit for delaying a signal to be supplied to said first right channel loudspeaker and a first variable gain amplifier for amplifying a signal to be supplied to said second left channel loudspeaker, and said second signal adjusting means includes a second variable delay circuit for delaying a signal to be supplied to said first left channel loudspeaker, and a second variable gain amplifier for amplifying a signal to be supplied to said second right channel loudspeaker.

8. The stereo reproduction system according to claim 7, further comprising a third variable gain amplifier for amplifying a signal to be supplied to said first right channel loudspeaker and a fourth variable gain amplifier for amplifying a signal to be supplied to said first left channel loudspeaker.

9. The stereo reproduction system according to one of claims 3 to 6, wherein said first signal adjusting means includes a first variable delay circuit for delaying a signal to be supplied to said right channel loudspeaker and a first variable gain amplifier for amplifying a signal to be supplied to said second left channel loudspeaker, said second signal adjusting means includes a second variable delay circuit for delaying a signal to be supplied to said first left channel loudspeaker, a second gain amplifier for amplifying a signal to be supplied to said second right channel loudspeaker, said third signal adjusting means is a third variable gain amplifier for adjusting the amplitude of a signal to be supplied to said third right channel loudspeaker, and said fourth signal adjusting means is a fourth variable gain amplifier for adjusting the amplitude of a signal to be supplied to said third left channel loudspeaker.

10. The stereo reproduction system according to claim 9, further comprising a fifth variable gain amplifier for amplifying a signal to be supplied to said first right channel loudspeaker and a sixth variable gain amplifier for amplifying a signal to be supplied to said first left channel loudspeaker.

11. The stereo reproduction system according to claim 2, wherein said first signal adjusting means includes a first variable gain amplifier for amplifying a signal to be supplied to said second left channel loudspeaker, said second signal adjusting means includes a second variable gain amplifier for amplifying a signal to be supplied to said second right channel loudspeaker, and said remote control means includes means for controlling said first and second variable gain amplifiers independently.

12. The stereo reproduction system according to one of claims 4 to 6, wherein said first signal adjusting means includes a first variable gain amplifier for amplifying a signal to be supplied to said second left channel loudspeaker, said second signal adjusting means includes a second variable gain amplifier for amplifying a signal to be supplied to said second right channel loudspeaker, and said remote control means includes means for controlling the gains of said first and second variable gain amplifiers independently.

13. The stereo reproduction system according to claim 12, wherein said third signal adjusting means is a third variable gain amplifier, said fourth signal adjusting means is a fourth variable gain amplifier, and said remote control means includes means for controlling the gains of said third and fourth variable gain amplifiers independently.

* * * * *